United States Patent [19]

Cox et al.

[11] Patent Number: 4,642,434

[45] Date of Patent: Feb. 10, 1987

[54] MICROWAVE REFLECTIVE ENERGY CONCENTRATING SPACER

[75] Inventors: David H. Cox, Robbinsdale; David W. Andreas, Minneapolis; James D. Watkins, Prior Lake, all of Minn.

[73] Assignee: Golden Valley Microwave Foods Inc., Eden Prairie, Minn.

[21] Appl. No.: 797,926

[22] Filed: Nov. 14, 1985

[51] Int. Cl.[4] ..... H05B 6/64

[52] U.S. Cl. ..... 219/10.55 E; 219/10.55 F; 426/107; 426/243; 99/DIG. 14

[58] Field of Search ..... 219/10.55 E, 10.55 F; 426/107, 110, 113, 241, 234, 243; 99/451, DIG. 14; 206/45.12, 45.2, 45.21, 45.31, 634, 830; 126/390

[56] References Cited

U.S. PATENT DOCUMENTS

| | | | |
|---|---|---|---|
| 2,612,596 | 9/1952 | Gross | 219/10.55 F |
| 2,993,633 | 7/1961 | Keller | 206/45.21 X |
| 3,835,280 | 9/1974 | Gades et al. | 219/10.55 E |
| 3,941,967 | 3/1976 | Sumi et al. | 219/10.55 E |
| 3,965,323 | 6/1976 | Forker, Jr. et al. | 219/10.55 E |
| 4,306,133 | 12/1981 | Levinson | 219/10.55 E |
| 4,499,356 | 2/1985 | Hatagawa | 219/10.55 E |
| 4,555,605 | 11/1985 | Brown et al. | 219/10.55 E |

*Primary Examiner*—Philip H. Leung

*Attorney, Agent, or Firm*—James V. Harmon

[57] ABSTRACT

A microwave reflective energy concentrating spacer is provided which consists of a horizontally disposed article supporting surface and a microwave reflector such as a sheet of metal foil spaced about ¼ of a wave length of the supplied microwave energy below the supporting surface. The spacer can be formed from flexible packaging materials such as paperboard panels to which the aluminum foil is bonded to form the reflective surface.

4 Claims, 6 Drawing Figures

MICROWAVE REFLECTIVE ENERGY CONCENTRATING SPACER

FIELD OF THE INVENTION

The present invention relates to the microwave heating of foods and to an improved device for heating the food more quickly and efficiently.

BACKGROUND OF THE INVENTION

The present invention resulted in part from the observation that a standardized package of food is heated more quickly in certain microwave ovens than others. Foods do not appear to couple well with the microwave energy in certain ovens causing less heating and poorer results in certain ovens than in others. For example, popcorn may not pop very well in some ovens. In virtually all home microwave ovens, food is supported on a ceramic or glass shelf or false floor that is spaced an inch or two above the metal oven floor. The distance of the false floor above the metal floor of the oven varies from one manufacturer to another. In the course of developing the present invention, it was found that a standardized package of food was subjected to different heating conditions in different ovens. It was also determined that the amount of heating, i.e., the efficiency with which heat is induced into the food, appeared to be influenced by the height of the false floor from the microwave reflective metal floor of the oven.

It is a general objective of the present invention to provide, in its preferred form, a device that will assure more uniform heating of foods in a variety of microwave ovens of differing dimensions and will improve, speed up and generally facilitate the heating of foods but which is formed entirely from flexible or semiflexible packaging materials adapted to be withdrawn from a roll, printed, cut and formed like a conventional package so that little if any is added to the cost of an ordinary package.

A number of devices have been previously proposed to assist in the heating of foods in a microwave oven. For example, U.S. Pat. No. 4,013,798 describes a box which forms a shield supporting a metal tray above a reflective bottom layer. However, the box extends over the top of the food and prevents microwave energy from reaching it from the top. The shielding effect of the box together with the loss of microwave energy through holes in the bottom layer tend to prevent microwave energy from reaching the food. Microwave energy is reflected away from both the top and bottom of the surrounding box.

U.S. Pat. No. 3,835,280 proposes a microwave perturbating device composed of two heavy layers of plastic having between them two concentric rings of aluminum foil. The plastic layers are relatively expensive due to the large amount of resin needed as well as molding and other fabricating costs. Moreover, the small size and shape of the reflective surfaces as well as the large space between them make the metal rings a poor reflector of microwave energy.

U.S. Pat. No. 4,306,133 describes a microwave heater in which food held in an aluminum pan rests upon a heater formed from silicon carbide which is itself mounted above a reflective plate 19. During operation, the silicon carbide absorbs microwave energy and as it becomes hot the heat is transmitted by conduction to the food product through the aluminum pan.

A variety of prepared foods are now sold in the supermarket within a package specifically designed to contain the food while the package is heated within a microwave oven. To be successful, these packages must be composed of inexpensive, flexible or semiflexible packaging material such as paper, paperboard or foil capable of passing through conventional paper and paperboard converting equipment such as printers, sheet cutters and the like. One important object of the invention is to improve the heating of such packaged foods without adding much to their cost.

In the accomplishment of the foregoing and related advantages and objectives, the invention comprises the features hereinafter fully described and particularly pointed out in the claims, the following description setting forth in detail certain illustrative embodiments of the invention by way of example, these being indicative, however, of but a few of the various ways in which the principles of the invention may be employed.

SUMMARY OF THE INVENTION

The present invention provides a microwave reflective energy concentrating spacer for facilitating the heating of food in a microwave oven. The device is composed of a spacer body preferably formed from either stiff or flexible packaging sheet material defining an upper supporting surface for supporting the food product and a lower microwave reflective surface spaced below the supporting surface by a distance of about $\frac{1}{4}$ the wave length of the microwave energy supplied by the oven. The microwave reflective surface is preferably a thin flexible sheet such as an electrically conductive sheet of metal foil, e.g., an aluminum foil sheet extending the width and breadth of the spacer and being substantially aligned with the food supporting surface. The portion of the spacer between the food supporting surface and the reflective surface is free from microwave reflective material. In this way, microwave energy from the oven strikes the microwave reflective surface from above and is reflected upwardly therefrom whereby the reflective surface acts as an artificial oven wall and forms a region of concentrated phase-reinforced microwave energy either inside or at the surface of the food article to thereby accelerate heating of the food at its surface or at a controlled depth within it.

THE FIGURES

DETAILED DESCRIPTION OF THE INVENTION

Figure 1:
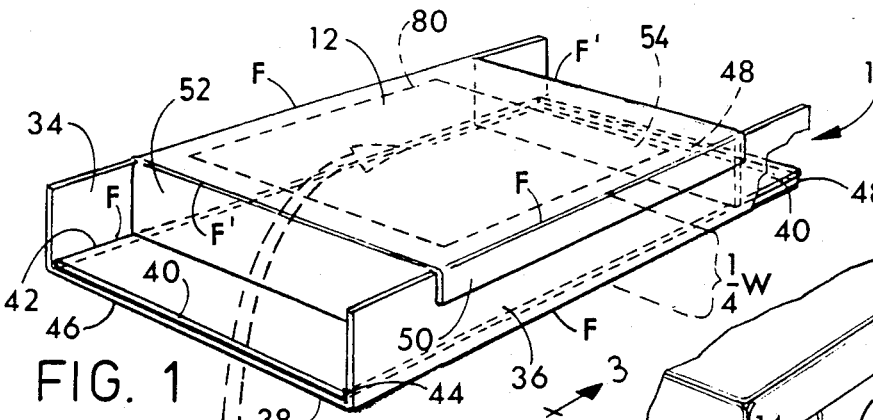
FIG. 1 is a perspective view of the invention set up ready for use.
Figure 2:
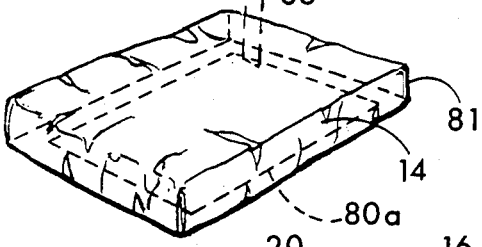
FIG. 2 is a perspective view of a microwave oven in which the invention is about to be used.
Figure 2:
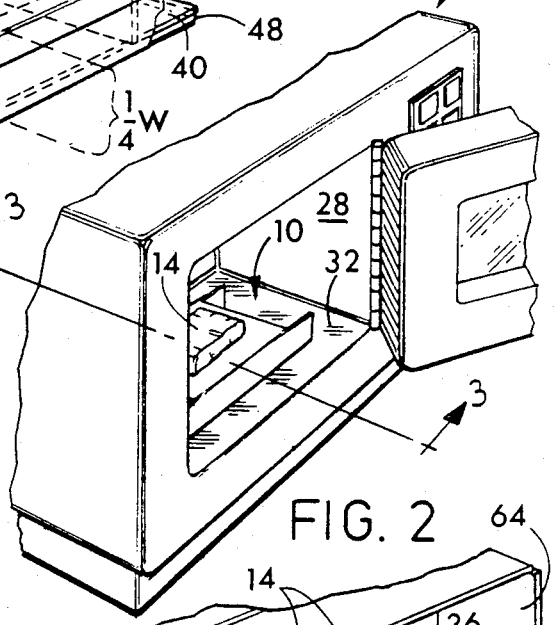
Figure 4:
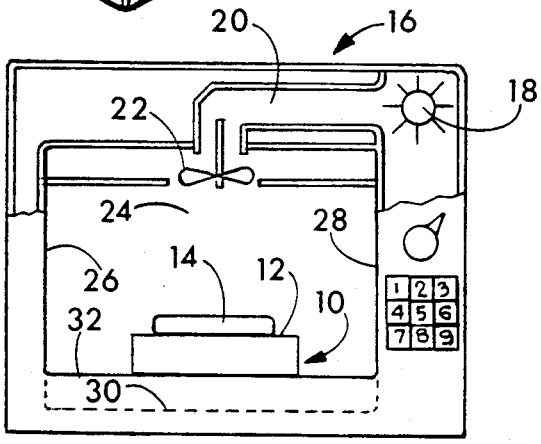
FIG. 4 is a front view of the oven in FIG. 2 partly broken away.
Figure 3:
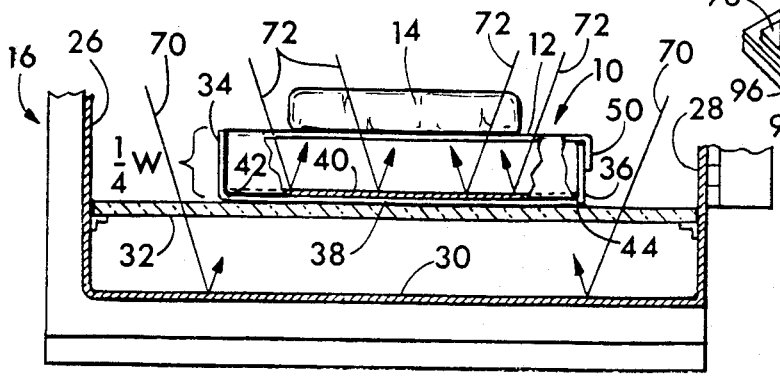
FIG. 3 is a transverse sectional view taken on line 3—3 of FIG. 2.

As shown in the figures, the invention concerns a spacer indicated generally by the numeral 10. The spacer 10 includes a flat upper supporting surface 12 for supporting a food product such as a package 14 of any of a variety of foods such as french fried or hash brown potatoes, hamburgers, pizza pie, unpopped popcorn or the like. When the food package 14 is to be heated, it is placed as shown by dotted lines in FIG. 1 on the supporting surface 12 of the spacer 10 and is put in a microwave oven 16 having a microwave generator 18 as shown in FIGS. 2–4.

The support surface 12 is rectangular in this instance and is spaced a predetermined distance; ¼ of the wave length W of the microwave generator 18 above a microwave reflective surface or sheet 40. Thus, during operation the microwaves from the microwave generator or magnatron 18 pass through the guide 20 past a stirring device 22, all of conventional construction, into an oven cavity 24 which includes metal side walls 26 and 28, metal bottom wall 30, and a typically ceramic supporting shelf or false floor 32. The microwave oven 16 per se is entirely conventional and forms no part of the present invention but is described here in part so that the principles under which the invention operate can be more easily understood.

The spacer 10 includes a pair of normally vertically disposed laterally spaced apart parallel side walls 34 and 36 which hold the top wall 12 a required distance from the bottom wall 38. The bottom wall 38 is composed of a cardboard sheet to the upper surface of which is bonded a rectangular sheet of microwave reflective sheet 40 such as aluminum foil or other reflective sheet material that serves as a microwave energy reflector, which, in effect, forms the bottom of the spacer. As can be seen in FIGS. 1 and 3, the microwave reflective sheet 40 includes left and right longitudinally extending parallel edges 42 and 44 and transverse parallel disposed edges 46 and 48.

It can be seen that the reflective sheet 40 extends the entire width and breadth of the spacer 10, is spaced beneath the supporting surface 12 and is positioned substantially parallel to it. The spacer 10 can be formed from a lightweight paperboard sheet divided into four rectangular panels connected together by means of fold lines F which form hinges. The two major panels consist of the food supporting surface 12 and the bottom wall 38. A tab 50 is provided at one edge of the panel defining the supporting surface 12. The tab 50 is glued to the panel 36. A pair of tabs 52 and 54 are hinged to the front and rear edges of the panel 12 at fold lines $F^1$. When the tabs 52 and 54 are folded downwardly along the hinges formed by the fold lines $F^1$ to a vertical position, the spacer 10 will be held in the upright or erect condition shown in FIG. 1. However, when the spacer 10 is to be folded flat, the tabs 52 and 54 are simply folded up until they are parallel with the support surface 12 whereupon the spacer 10 can be collapsed, i.e., flattened to the configuration in FIG. 5.

Figure 5:
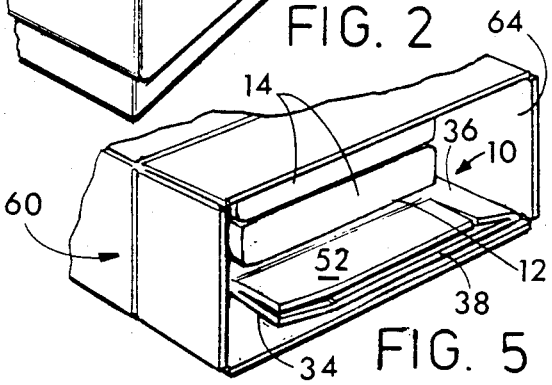
FIG. 5 is a partial perspective view of the package embodying the invention and FIG. 6 is a perspective view of another form of the invention.

Refer now to FIG. 5 which illustrates a typical application of the invention. As shown in FIG. 5, the spacer 10 is placed in a shipping container 60 such as a lightweight paperboard carton together with a pair of prepackaged food products 14. It can be seen that the spacer 10 is in a collapsed condition with the tabs 50 and 52 folded up to a horizontal position parallel with the product support surface 12. After the container 60 is opened, the spacer 10 and the prepackaged food articles 14 are removed, in this case by sliding them out through the open end 64. The spacer 10 is then erected by pressing on the fold lines F and bending the tabs 52 and 54 downwardly about the fold lines $F^1$ until they reach a vertical position thereby holding the spacer 10 in the erect condition of FIGS. 1 and 3 ready for use. The spacer is then placed in the oven on the false floor 32 and one of the prepackaged food articles 14 is placed on the support surface 12.

During operation, as shown in FIG. 3, microwave energy indicated by lines 70 will pass through the oven first past the stirrer 22 downwardly on either side of the support through the false floor 32 and will be reflected upwardly by the bottom wall 30 of the oven chamber. Some of the other microwave energy will pass downwardly through the food product as indicated by diagonal lines 72, the microwave energy striking conductive sheet 40, thereby reflecting microwave energy back up into the food product 14. It has been found that by placing the food product approximately ¼ of a wave length from the reflective surface 40, many of the waves reflected from the surface 40 will reach an energy maximum through phase reinforcement at approximately the lower surface of the food product or somewhat inside the food product. This is believed to be due to the tendency for microwave energy to be reflected in phase from a reflective surface so that most of the waves reflected upwardly from the surface 40 are in phase and at maximum energy in proximity with supporting surface 12 thereby forming a high energy region in the vicinity of the food article 14, particularly in proximity with its lower surface or somewhat above its lower surface. In a typical microwave oven operating at a frequency of 2450 MZ, the wave length is 12 cm. and accordingly the height of the spacer should be about 2.5 or 3 cm. If the height of the spacer 10 is 3 cm., energy will peak at the surface 12. If it is 2.5 cm., it will peak inside the food product a distance of about ½ cm. In this way it can be seen that the reflective sheet 40 acts as an artificial oven floor forming a region of concentrated phase reinforced microwave energy either inside or at the surface of the food article 14 to thereby enhance and accelerate heating.

By reference to FIG. 3, it will be noticed that microwave radiation indicated by diagonal lines 72 in the region of the food product 14 will pass downwardly around the food product and through it, striking the upper surface of the reflective sheet 40. The wave energy will then be reflected upwardly a distance of approximately 3 cm. with the peak energy at approximately the interface between the food product 14 and the supporting surface 12. The wave reinforcement will peak at about the same plane. It should be noticed that regardless of the height of the false floor 32 of the oven 16, the same energy concentration will be provided very close to the lower surface of the food product.

Optionally, and in accordance with the present invention, there is provided a microwave absorbing sheet 80 of the type which becomes hot when exposed to microwave energy. The sheet 80 can comprise any lossy sheet material known to the art for roasting or scorching foods such as a sheet of a finely divided ferrite, a semiconductive metalized coating such as electrodeposited aluminum, copper, silver, chromium or the like and being electrically semiconductive during operation. The wave energy reflected upwardly from the conductive surface 40 will reach a peak in the vicinity of the optional lossy sheet 80 causing it to become extremely hot and to heat the surface of the food product 14 by conduction. This will cause an even further improvement in the heating effectiveness as judged by a reduction in heating time, surface browning or searing, or better results in low powered ovens. Alternatively, the lossy heating sheet 80 can be bonded to the lower surface of the wrapper 81 of the food package 14 as shown in FIG. 1. In this embodiment of the invention, it is important to provide directions for placing the food package 14 so that the microwave absorbing heating sheet 80 is positioned downwardly against the supporting surface 12.

In accordance with a variation of the invention, the spacer 10 is itself used as a box or carton for the food article 14. The food article 14 is thus stored within the spacer between the supporting surface 12 and the reflective surface 40. When the food article is to be heated, it is removed and placed on top of the support surface 12 and accordingly the spacer has a dual purpose.

Figure 6:
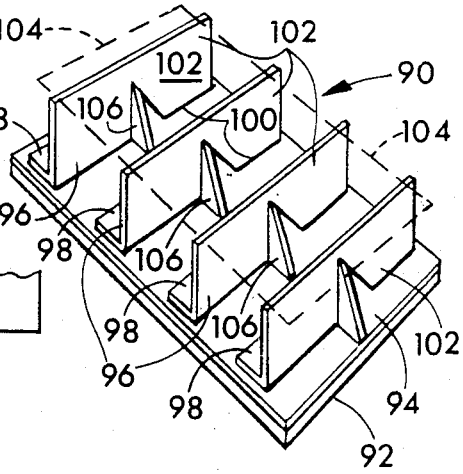

Refer now to FIG. 6 which illustrates another embodiment of the invention in which a spacer 90 for heating foods in a microwave oven is composed of a base 92 consisting of a flat rectangular sheet of paperboard to which is bonded an electrically conductive microwave reflective sheet 94 such as a sheet of lightweight aluminum foil. To the sheet of aluminum foil 94 is bonded a plurality of transversely extending parallel longitudinally spaced apart paper strips 96 each having a base tab 98 glued to the aluminum foil 94 and connected by means of a fold line 100 to an upright flap 102 having a height of about ¼ of the wave length of the microwave energy used, establishing a support surface 104 in the plane containing their upper edges. Flaps 102 are held in an upright position in any convenient way as by means of triangular shaped folding braces 106. When a food product is being shipped, the spacer 90 is folded flat. Whenever the spacer 90 is to be used, the flaps 102 are folded upwardly to an erect position and the braces 106 are folded as shown to hold each of the flaps 102 in a vertical position. The food article 14 is then placed on the spacer 90 with its lower surface located in the supporting plane 104 defined by the upper edges of the flaps 102. The operation is otherwise the same as the spacer 10.

The invention has been found highly effective in facilitating efficient microwave heating. For example, in popping microwave popcorn in a Litton Sand 5 oven, the average final volume of the popped popcorn was increased from 650 cc. to an average of 1650 cc. without the heating sheet 80. Under similar conditions, the same quantity of popcorn which reached an average of 1650 cc. after popping in a Panasonic 700 watt oven showed an average increase to 2150 cc. using the invention without the sheet 80. On the other hand, when the sheet 80 was used, the final popped volume, starting with equal amounts of corn, was increased from 2000 cc. to 2400 cc. using the invention in a Litton Sand 5 oven. This shows that the invention may increase the volume of popped corn from 20% to over 100%. In addition, the spacer 10 has an extremely low mass and is formed from readily available packaging materials that can be printed, cut, glued and formed using conventional paper processing equipment. It is, moreover, collapsible and adds little to the cost or size of the package. Furthermore, food is heated consistently regardless of how far the false floor 32 is located from the floor 30 of the oven. Typically, the shelf 32 is 5 cm. from the floor 30 of a Litton Sand 5 oven, 1.5 cm. in a Panasonic 700 watt oven, 3 cm. in a Samsung oven and about 7 cm. in a Tappan consumer oven. However, when the invention is used, efficient and rapid heating can be obtained with the same good results in each of the ovens.

It will be seen, particularly in FIG. 1, that the relfective surface 40 extends somewhat beyond the ends of the support surface 12. This has two advantages. The surface 12 serves as a guide for centering the food product at approximately the center of the reflective surface 40. At the same time, the part of the reflective surface which extends beyond the ends of the food product will gather additional microwave energy reflecting it upwardly into the food. The invention is susceptible to many different forms for various applications, e.g., a sheet or block of foam plastic about 2.5 to 3 cm. in height having an aluminum foil sheet bonded to its lower surface. This form is not, however, foldable or collapsible, cannot serve as a container and requires more raw material in its fabrication.

Many variations of the invention within the scope of the appended claims will be apparent to those skilled in the art once the principles of the invention described above are understood.

What is claimed is:

1. A foldable and collapsible microwave reflective energy concentrating spacer that can be shipped in a food package for facilitating the heating of food in a microwave oven having a microwave transparent supporting shelf located an indeterminate distance above a microwave reflective oven floor comprising, a spacer body defining an upper support surface for supporting a food article thereon and a lower microwave reflective surface spaced below the supporting surface by a distance of about ¼ wave length of the microwave energy supplied by the oven, whereby when said microwave energy has a wavelength of 12 cm said distance is about 2.5 to 3 cm, said microwave reflective surface comprising microwave reflective sheet material extending the width and breadth of the spacer body and being substantially aligned with the support surface, a portion of the spacer body between the support surface and the reflective surface being composed of microwave transparent material, whereby microwave energy from the oven striking the reflective surface of the spacer body from above is reflected upwardly therefrom such that the reflective surface acts as an artificial oven floor forming a region of concentrated phase-reinforced microwave energy inside the food or at the surface of the food article resting upon said upper support surface to thereby enhance heating of the food by providing a uniformly high level of heating without regard to the distance between the supporting shelf of the oven and the oven floor, and said spacer body is formed from a plurality of panels of microwave transparent sheet material connected by hinges at intersecting edges which are parallel to one another to define a spacer that is adapted to be folded flat for compact storage and shipment in said package by folding the spacer body at the parallel hinges to a flattened condition, one of the panels comprising a horizontal bottom wall panel including a metal foil defining said microwave reflective surface and movable members operationally associated with the panels to hold the spacer body in an upright condition during use to support the weight of the food resting on the upper support surface.

2. The spacer according to claim 1 wherein the spacer body comprises a rectangular normally horizontally disposed panel defining the supporting surface, a rectangular horizontally disposed panel defining the reflective surface and a pair of vertically disposed side panels connected by means of said hinges between the aforesaid panels and each side panel having a height of about 2.5 to 3 cm.

3. The spacer of claim 1 wherein said moveable members are tabs hinged to the spacer body for folding to vertical positions to maintain the spacer body in an erect condition.

4. The microwave reflective energy concentrating spacer of claim 1 wherein a microwave energy absorbing heating sheet formed from a lossy material is provided in close proximity to the supporting surface to absorb microwave energy reflected upwardly from the reflecting surface, the microwave absorbing heating sheet being thereby located in the region of concentrated phase-reinforced microwave energy provided by the reflective surface for optimal heating thereof and said heating sheet is in heat transfer relationship with the food article to thereby heat the food article through conduction of heat from itself to the food article.

* * * * *